United States Patent [19]

Hornung

[11] Patent Number: 4,544,324

[45] Date of Patent: Oct. 1, 1985

[54] QUICKCHANGE FORK

[75] Inventor: Steve Hornung, Brampton, Canada

[73] Assignee: Kenhar Products Incorporated, Brampton, Canada

[21] Appl. No.: 490,051

[22] Filed: Apr. 29, 1983

[51] Int. Cl.[4] ..... B66F 9/12

[52] U.S. Cl. ..... 414/785; 403/49; 403/330; 24/512

[58] Field of Search ..... 414/785, 664, 668, 667, 414/686, 723, 724; 403/49, 154, 157, 330; 294/67 A, 82 R; 24/241 P, 512, 498, 489

[56] References Cited

U.S. PATENT DOCUMENTS

| | | | |
|---|---|---|---|
| 1,362,512 | 12/1920 | Schermuly | 24/241 P |
| 1,516,806 | 11/1924 | Amrin | 24/241 P |
| 3,232,380 | 2/1966 | Hansen | 414/667 X |
| 4,225,283 | 9/1980 | Baker et al. | 414/723 |
| 4,426,188 | 1/1984 | Wolf et al. | 414/785 X |

FOREIGN PATENT DOCUMENTS

| | | | |
|---|---|---|---|
| 2903462 | 8/1980 | Fed. Rep. of Germany | 294/82 R |
| 604732 | 7/1948 | United Kingdom | 294/82 R |
| 2040261 | 8/1980 | United Kingdom | 414/667 |

*Primary Examiner*—Robert J. Spar
*Assistant Examiner*—David A. Bucci
*Attorney, Agent, or Firm*—Rogers, Bereskin & Paar

[57] ABSTRACT

A mechanism for removably securing forks to a forklift truck and the like includes a hook shaped upper end for engaging a support shaft mounted on the forklift truck and a freely pivotal release mechanism attached to the shank of the fork having a first surface closely adjacent to the shaft on which the fork is mounted. The pivoting release mechanism precludes disengagement of the hook from the supporting shaft when the fork is in operating position. Upon pivotal movement of the fork about this supporting shaft the pivotally mounted release mechanism pivots under the effect of gravity to present a second surface adjacent to the supporting shaft thereby permitting disengagement of the fork from the shaft.

6 Claims, 7 Drawing Figures

QUICKCHANGE FORK

This invention relates to mechanisms for securing forks to forklift trucks to enable the forks to be readily changed.

Forklift trucks are widely recognized commercial vehicles used for material handling in various commercial premises such as storehouses, warehouses and the like. In addition, such lift trucks are also used for the handling of heavy goods in the manufacturing processes. Many forklift vehicles are used as multipurpose vehicles and are used at various times for material handling, transport of bulky articles or special material handling. An example of special material handling is in the moving of rugs in which a single tine type of fork is fitted to the vehicle, the tine being extended so as to slide down the centre of a roll of carpet. Many other special use forks are used with the common lift truck vehicle.

Most lift truck vehicles have a central substantially horizontal shaft or rail which is used to support the forks. Where the vehicle is to be used as a multipurpose vehicle several sets of different forks may be used with the vehicle. Heretofore, such interchangeable forks have been located on the substantially horizontal support shaft of the trucks by means of a tubular collar member welded to the top of the fork. When the purpose of the vehicle is to be altered the fork already on the vehicle is slide transversely to the vehicle and removed from the support shaft. Then a different type of fork may be slide into the working position. In most cases, other collars are applied to the horizontal shaft to ensure that the fork does not move in the transverse direction during use. One of the major problems with existing vehicles of this type is that under the sometimes very heavy loads applied to the fork in the lifting process the horizontal support shaft upon which the forks are located will gradually be bent downwardly. When excessive bending of the shaft has finally occurred the fork will no longer slide transversely to be removed. In such cases the fork must then be cut from the vehicle or alternatively, the horizontal support shaft for the forks must itself be cut from the vehicle and replaced. When the shaft has reached this bent condition it is obviously time consuming and expensive to attempt to continue to use the truck as a multipurpose vehicle.

In order to provide a fork which may be quickly and easily removed from the truck it has been known to supply a fork with an open hook at the top of the shank. The hook which opens outwardly towards the tine, that is to say away from the vehicle itself, can be readily attached to the horizontal supporting shaft of the truck. Those familiar with such forklift vehicles will appreciate that the vehicle is provided with a stop against which the shaft of the fork rests so that the fork cannot rotate to allow the tine to move below a substantially horizontal plane. The problem with such forks having open hooks is that no safety measure whatsoever is provided. If the fork is rotated about the support shaft such that the tine extends above a substantially horizontal plane such as when the mast of the vehicle is lowered below the point at which the tine contacts a surface, then the fork will fall from its supporting shaft upon relatively few degrees of rotation about the horizontal shaft. While manual pins or latches or the like could be used to block the opening of the hook and thus preclude accidental removal, such latches are not normally acceptable as in use the latches are damaged and inevitably with the passage of time operators of the trucks remove the latches or otherwise defeat the safety purpose thereof.

According to this invention there is provided a relatively simple release mechanism for removably attaching a fork to a forklift truck having a horizontal support shaft. The quickchange fork comprises a tine and a shank. Affixed to the shank is a release mechanism for removably securing the shank to a horizontal shaft of the truck. The release mechanism includes hook means and a lock member which is secured for movement with respect to the shank of the fork about a substantially horizontal axis between a first and second position with respect to the shank. When the lock member is in the first position it prevents disengagement from the horizontal supporting shaft while permitting disengagement while in the second position. The lock member is freely pivotable under the effect of gravity when the fork is rotated about the supporting shaft.

According to a preferred embodiment of the invention the upper surface of the release mechanism comprises a part circular curve with the radius of the curve being slightly less than the distance from the pivotal connection of the release mechanism to the shaft. Thus, for rotation of the shank about its supporting shaft there is no increase in clearance between the supporting shaft and the release mechanism while the upper surface remains adjacent to the shaft. The release mechanism has a second surface which is relieved such as to provide substantial clearance between the opening of the hook and the shaft when the second surface is opposite the opening of the hook. When in this latter position the fork may be readily removed from the supporting shaft.

The invention will be more clearly understood when considered in association with the following description of a preferred embodiment of the invention and in which.

Figure 1:
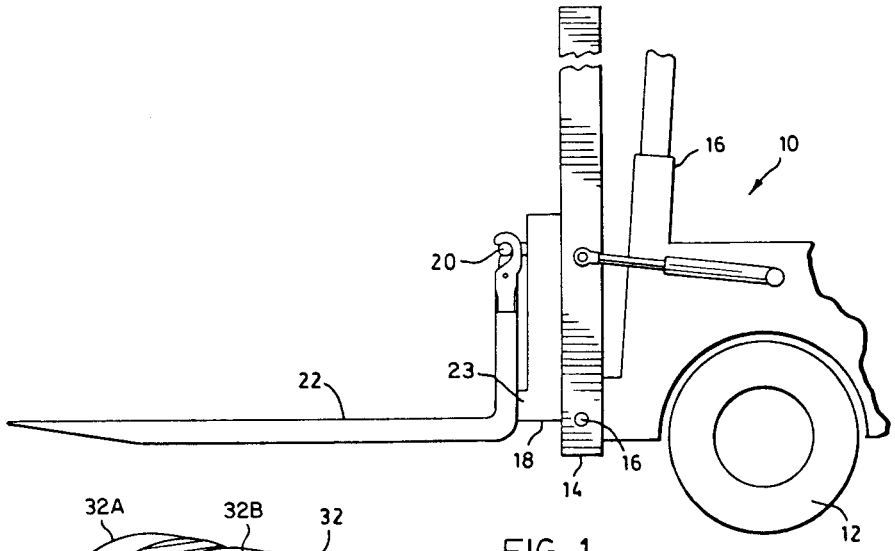
FIG. 1 is a view of a lift truck having a fork according to a preferred embodiment of the invention installed thereon.

FIG. 1 illustrates generally a conventional forklift truck indicated as 10. The truck includes the usual forward support wheels 12. There is provided a mast structure 14 adapted to be tilted about a pivot 16 forward and rearward toward a fixed mast 16 on the vehicle. The mast 14 supports a carriage 18 for up and down movement. Attached to the carriage 18 is a substantially horizontal shaft 20. The horizontal shaft 20 is the shaft on which the forks are supported and carry the entire lifting load. A fork indicated generally at 22, only one of which is shown for simplicity, is supported by the shaft 20. When the forklift vehicle picks up a load on the fork 22 the fork 22 would tend to rotate about the horizontal shaft 20. A reaction bar 23 on the carriage 18 prevents any rotation of the fork in a direction which would permit the tine of the fork to extend below the horizontal position illustrated in FIG. 1. It will be observed that there is no structure preventing upward lifting of the tine. Those familiar with the operation of such vehicles will appreciate that when the operator is lowering pallets and the like, particularly in warehouses where the pallets may be lowered to upper level shelving, it is important that the tine be allowed to move upwardly rotating about the shaft 20 as the mast is lowered below the surface of the shelf in order to prevent the weight of the forklift vehicle being placed on the shelf.

Figure 3:
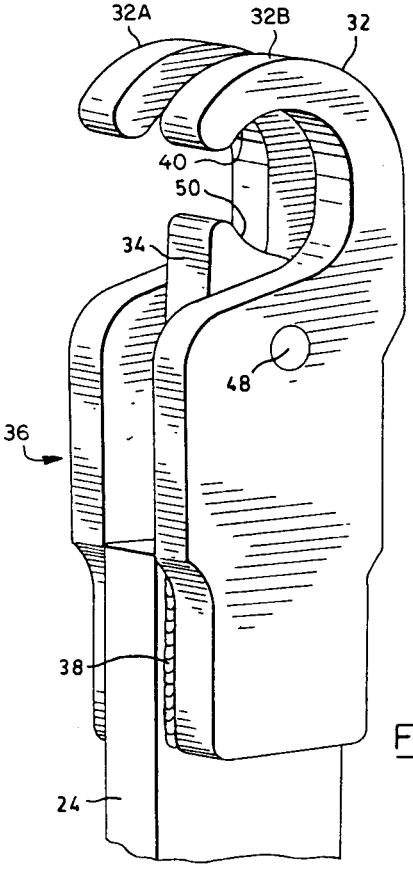
FIG. 3 is a perspective view of the mechanism for attaching the fork of FIG. 1 to the lift truck.
Figure 4:
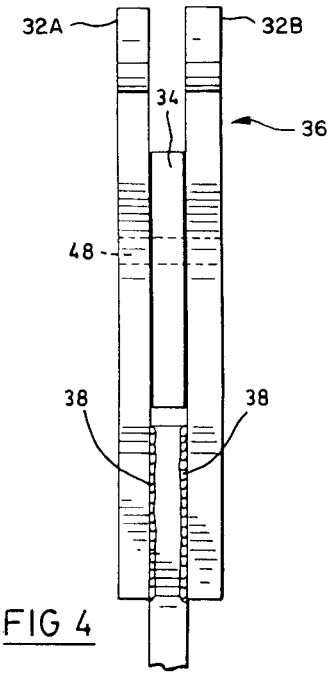
FIG. 4 is a front view of the mechanism of FIGS. 2 and 3.
Figure 2:
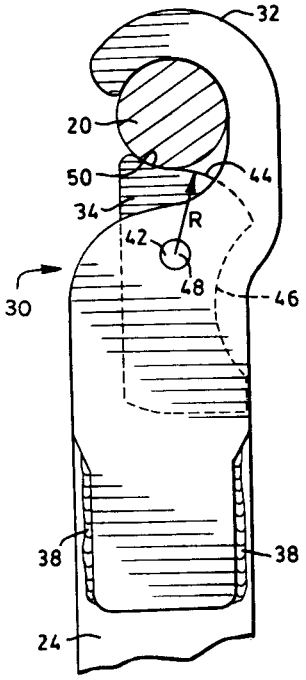
FIG. 2 is a side view of the mechanism for attaching the fork of FIG. 1 to the lift truck.

FIGS. 2, 3 and 4 show in enlargement the release mechanism 30 which is affixed to the upper end of the shank 24 of the fork 18 with the fork supported on the shaft 20.

The release mechanism comprises two component parts, a hook portion 32 and a lock member 34.

The hook 32 as shown in FIGS. 2, 3 and 4 advantageously comprises two like hooks in the form of a yolk 36 affixed to the end of the shank 24. The yolk 36 may be welded to shank at welds 38. The hook portion 32 includes two hooks 32A and 32B which have an interior surface 40 which closely receives the support shaft 20. The hooks 32A and 32B open forwardly, that is away from the mast 14. Sufficient clearance is provided between the shaft 20 and the carriage 14 only to receive the hook 32. The hook 32 cannot be removed from the shaft 20 by movement of the shank 24 toward the carriage.

The second component part of the release mechanism is the lock member 34. Lock member 34 is freely pivotable about the axis of a substantially horizontal pin 42 which extends between hooks 32A and 32B of the yolk 36. The lock member has an upper surface 44 and a rearward surface 46. Upper surface 44 is the locking surface and prevents disengagement of the hook 32 from shaft 20 when adjacent shaft 20. The hook 32 may be disengaged from shaft 20 when rearward surface 46 which is the release surface is adjacent shaft 20.

In the preferred embodiment illustrated, the axis 48 of pin 42 is vertically below the axis of shaft 20. This is not necessary but is most convenient. Upper surface 44 of the lock member 34 is described by a radius "R" from axis 48. The forward portion of surface 44 may optionally include a portion 50. The surface 50 is at a greater distance from axis 48 than "R". It will be noted from FIG. 2 that "R" is only slightly less than the distance from axis 48 to the surface of shaft 20. It will also be noted that the diameter of the shaft 20 is greater than the distance between the tip of hook 32 and surface 44. Accordingly, while surface 44 remains adjacent the tip of the hook 32 the hook 32 cannot be removed from the shaft 20. Surface portion 50 merely prevents the lock member from being rotated about axis 48 in the clockwise direction as illustrated in FIG. 2. Finally, from reference to FIG. 2 it will be noted that surface 46 is closer to axis 48 than "R". As illustrated, surface 46 advantageously comprises an arc such that the surface is relieved or at a distance from axis 48 or less than "R".

Figure 5:
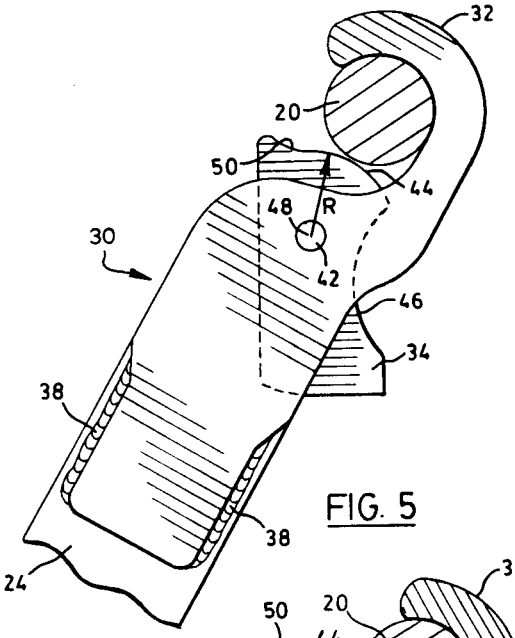
FIG. 5 is a side view of the mechanism of FIG. 2, the fork having been rotated 30°.
Figure 6:
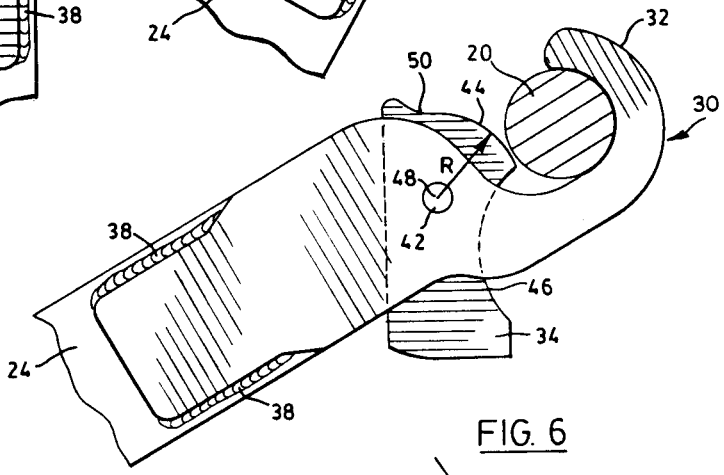
FIG. 6 is a side view of the mechanism of FIG. 2, the fork having been rotated 60°.
Figure 7:
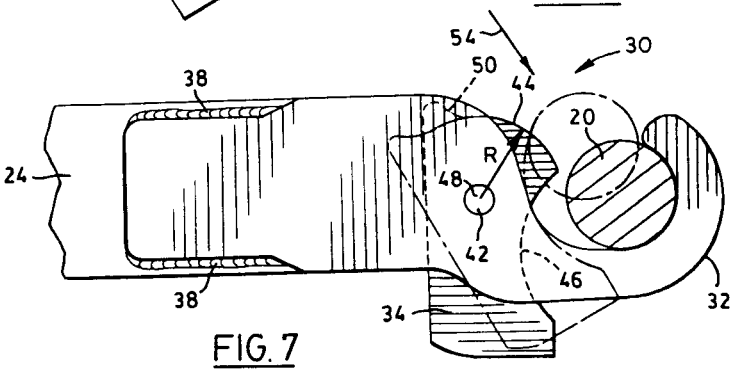
FIG. 7 is a side view of the mechanism of FIG. 2, the fork having been rotated 90° to a position where the fork may be removed from its supporting shaft.

To understand the operation of the release mechanism reference should be had to FIGS. 5 through 7. To remove the fork 20 from the shaft the fork is rotated clockwise about shaft 20 as illustrated in the figures. Lock member 34 which is freely pivotable about axis 48 has its center of gravity well below this axis. Thus as the fork 24 is rotated the lock member remains with surface 44 as its upper surface and surface 46 as its rear surface. There is not sufficient clearance to remove the hook from shaft 20 until the fork has been rotated until as shown in FIG. 7 surface 46 is adjacent the shaft 20. At this point the hook may be disengaged by moving the hook downwardly in the direction of arrow 54.

The hook 32 cannot be disengaged from the shaft 20 when surface 44 is adjacent the shaft 20 even though the lock member 34 is free to pivot about axis 48. This may be understood by considering the relative movement between the shaft 20 and the lock member 34. If removal is attempted the shaft 20 will come into engagement with surface 44. Because each of these surfaces is an arc of a circle the line of force from the shaft will pass through the axis 48, in which case, there is no torque applied to lock member 34. Because there is no torque applied to the lock member it will not rotate about axis 48 under the force applied by shaft 20 and accordingly disengagement is not possible. Even if due to surface irregularities and manufacturing tolerances, a small torque is applied to lock member 34, the lock member can pivot about axis 48 only by sliding movement between surface 44 and the surface of shaft 20. This sliding movement is precluded by the normal force between these two surfaces and typical friction.

In FIG. 7 the position of the lock member 44 under the effect of gravity is shown in solid lines, dotted lines being used for the hidden surfaces. The second position of the lock member 48 illustrated in chain dashed lines, illustrates the lock member being rotated slightly about its axis 48 as the fork is moved in the direction of arrow 54 relative to the shaft 20. When in the configuration illustrated in FIG. 7 the shaft 20 will contact the lock member 44 at the surface 46 or at least at the intersection of surfaces 44 and 46. When the lock member 34 is contacted at the surface 46 it may be rotated about its axis 48 to permit disengagement of the hook 32 from the shaft 20.

For simplicity of drawing and explanation, shaft 20 has been shown as having a uniform diameter. In practice shaft 20 may have notched portions to preclude transverse movement of the fork along the shaft. The release mechanism of this invention is useful in such circumstances, the only change which is required is the dimensioning of the lock member so as to be adjacent the surface against which contact is to be made to preclude removal.

By selecting the extent of upper surface 44, the fork designer can choose the angle of rotation of the fork which is necessary for disengagement. Accidental removal of the fork on minor rotation is prevented while at the same time giving a simple mechanism which requires only that the fork be rotated relative to the support shaft for assembly and disassembly. The safety mechanism cannot be readily defeated by an operator.

I claim:

1. A quickchange fork for a forklift truck having a substantially horizontal shaft for supporting said fork on said truck, comprising;

a fork having a tine and a shank, a release mechanism fixed to said shank for removably securing said fork to said shaft, said release mechanism having forwardly opening hook means, and a lock member secured for pivotal movement with respect to said shank about a substantially horizontal axis between first and second positions with respect to said shank, said lock member preventing disengagement of said hook means from said shaft when in said first position said lock member permitting disengagement of said hook means from said shaft when in said second position, and said lock member is freely pivotal under the effect of gravity when said fork is rotated about said shaft, and wherein the center of gravity of said lock member is always below said horizontal axis so that said lock member rotates about said axis when said fork is rotated about said shaft.

2. A quickchange fork for a forklift truck having a substantially horizontal shaft for supporting said fork on said truck, comprising a fork having a tine and a shank, a release mechanism fixed to said shank for removably securing said fork to said shaft, said release mechanism having forwardly opening hook means, and a lock member secured for pivotal movement with respect to said shank about a substantially horizontal axis between first and second positions with respect to said shank, said lock member preventing disengagement of said hook means from said shaft when in said first position said lock member permitting disengagement of said hook means from said shaft when in said second position, said lock member freely pivotal under the effect of gravity when said fork is rotated about said shaft, said lock member having a center of gravity below said horizontal axis, and said lock member having an upper surface and a rearward surface, said upper surface comprising a portion of an arc about said horizontal axis of radius "R" and said upper surface is adjacent the surface of said shaft when said lock member is in said first position.

3. The fork of claim 1 wherein the diameter of said shaft is greater than the distance between the tip of said hook means and said horizontal axis less "R".

4. The fork of claim 3 said lock member having a rearward surface which surface is closer to said horizontal axis than "R".

5. The device of claim 4 wherein said upper surface of said lock member comprises a forward portion which is spaced from said axis by a distance greater than "R".

6. The device of claim 3, 4 or 5 wherein said hook means comprises two spaced hooks forming a yolk for receiving said shank and said lock member is pivotable within said yolk.

* * * * *